US007281402B2

(12) United States Patent
Kirchhoff

(10) Patent No.: US 7,281,402 B2
(45) Date of Patent: Oct. 16, 2007

(54) METHOD AND APPARATUS FOR OPTIMIZING FORGING PROCESSES

(75) Inventor: Stefan Kirchhoff, Dortmund (DE)

(73) Assignee: Speciality Minerals (Michigan) Inc., Bingham Farms, MI (US)

( * ) Notice: Subject to any disclaimer, the term of this patent is extended or adjusted under 35 U.S.C. 154(b) by 301 days.

(21) Appl. No.: 10/842,145

(22) Filed: May 10, 2004

(65) Prior Publication Data

US 2005/0247092 A1 Nov. 10, 2005

(51) Int. Cl.
*B21J 7/46* (2006.01)

(52) U.S. Cl. ..... 72/16.7; 72/16.8; 72/18.6; 72/19.4; 72/19.6; 72/377; 72/352

(58) Field of Classification Search ..... 72/16.7, 72/16.8, 15.4, 15.5, 18.5, 18.6, 19.4, 19.6, 72/8.8, 8.9, 11.5, 11.6, 12.5, 12.7, 76, 377, 72/352, 278, 282, 285; 356/634, 640
See application file for complete search history.

(56) References Cited

U.S. PATENT DOCUMENTS

| | | | | |
|---|---|---|---|---|
| 3,972,211 | A * | 8/1976 | Linthicum et al. | 72/12.5 |
| 4,201,476 | A * | 5/1980 | Musto et al. | 356/640 |
| 5,028,798 | A | 7/1991 | Biswas et al. | |
| 5,402,663 | A * | 4/1995 | Rit et al. | 72/11.5 |
| 5,546,176 | A | 8/1996 | Jokinen | |
| 5,706,090 | A | 1/1998 | Jokinen | |
| 6,138,052 | A | 10/2000 | Kristensen | |
| 6,845,645 | B2 * | 1/2005 | Bartrom et al. | 72/15.5 |

FOREIGN PATENT DOCUMENTS

| | | | |
|---|---|---|---|
| DE | 37 23 825 | A1 | 7/1987 |
| DE | 3934236 | A1 | 4/1990 |
| DE | 198 08 462 | A1 | 3/1998 |
| DE | 100 18 107 | A1 | 4/2000 |
| FR | 2128950 | A | 10/1972 |
| GB | 1003153 | | 9/1965 |
| WO | WO 01/38900 | A1 | 5/2001 |

OTHER PUBLICATIONS

Translation of DE 3723825 A1.*
"Laser Measurements On Large Open Die Forging (LACAM-FORGE)", Kirchhoff et al., p. Nos. 137-140.
"Optimizing of the Forging Process of Heavy Forging For Power Generation Machinery", Blaes et al., p. Nos. 93-102.
"Uniform Deformation In Open Die Forging By Optimizing Pass Schedules And Bite-Shift", Lundback et al., p. Nos. 375-381, 138.

* cited by examiner

*Primary Examiner*—Dmitry Suhol
(74) *Attorney, Agent, or Firm*—Leon Nigohosian, Jr.; Derek S. Jessen

(57) ABSTRACT

A method and apparatus for optimizing the forging of a workpiece that is moved along a longitudinal axis of a forging press. The method includes detecting the relative positions of the first and second ends of the workpiece along the longitudinal axis and calculating a length of the workpiece therebetween.

16 Claims, 8 Drawing Sheets

WIDTH OF CENTER LINE CONSOLIDATION AREA:

$$d_n = S_b - H_D / F$$

WITH FACTOR $F \geq 2$ AND IF $(d_n < 0)$ THEN $d_n = 0$

METHOD AND APPARATUS FOR OPTIMIZING FORGING PROCESSES

The use of open die forging to form and/or draw a metallic workpiece between upper and lower dies of a forging press is known, particularly with respect to forging operations of large size workpieces (e.g., for power generation machinery, crank shafts). One important aspect with respect to the quality of a forged product, is a uniform and thorough forging of the core of a workpiece in order to eliminate cavities and other inclusions in the workpiece that impair quality. To achieve a uniform consolidation of the center line, the center line being the direction in which the workpiece is moved forward and backward wherein the center of mass of the workpiece is considered the center line of a workpiece being forged. One process known as "cogging" is used to convert coarse-grained, cast ingot into fine-grained, wrought billet or in other words break down the coarse cast structure and consolidate internal defects in the work piece. In many forging shops, because of various constraints imposed by a large-scale forging operation of red-hot workpieces, forging processes are controlled by a human operator. In such processes, the operator controls center line consolidation by visual inspection to determine consolidation areas of the last forging pass, which appear as bright structures at the side of the workpiece. From experience, the operator then estimates the placement of the next cogging blows or "setup points" to improve centerline consolidation.

Operator-related variations in process control and also variations of the achieved consolidation quality can result, however, which can lead to a high rejection rate in terms of quality management and economy. Moreover, if a workpiece is not inspected for the absence of such defects until it has first been drawn or deformed, cavities and other inclusions originating in the casting process could remain after the forging process. These defects typically require additional forging and/or discarding of the workpiece that can result in the loss of work time, material, and/or energy costs.

The foregoing illustrates limitations known to exist in present forging control apparatus and methods. Thus it is apparent that it would be advantageous to provide an alternative directed to overcoming one or more of the limitations set forth above. Accordingly, an alternative forging control apparatus and methods are described including the features more fully disclosed hereinafter.

SUMMARY OF THE INVENTION

According to the present invention, a method and apparatus for optimizing the forging of a workpiece that is moved along a longitudinal axis of a forging press. The method includes detecting the relative positions of the first and second ends of the workpiece along the longitudinal axis and calculating a length of the workpiece therebetween.

The foregoing and other aspects will become apparent from the following detailed description of the invention when considered in conjunction with accompanying drawing figures.

DETAILED DESCRIPTION OF THE INVENTION

Figure 1:
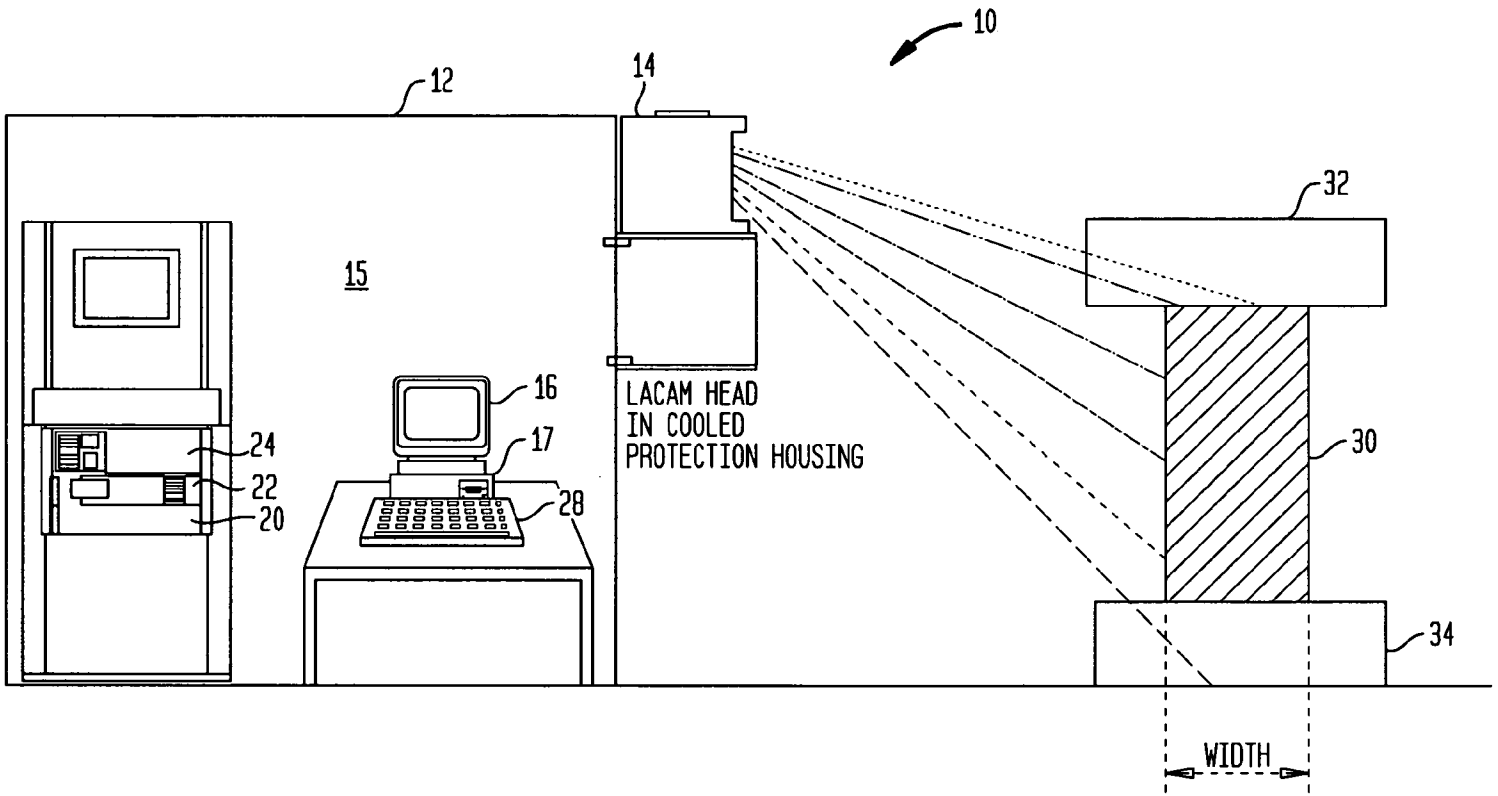
FIG. 1 is a perspective view of the forging control system used in conjunction with a forging press according to the present invention.

The invention is best understood by reference to the accompanying drawings in which like reference numbers refer to like parts. It is emphasized that, according to common practice, the various dimensions of the component parts of the apparatus as shown in the drawings are not to scale and have been enlarged for clarity. Also, the directional designations "left" or "right" are not to be construed as limited to any specific orientation but, rather, are for reference purposes as they pertain to the views as shown in the drawing figures.

According to the apparatus and method of the present invention as described herein, a contactless method and apparatus are provided for controlling a forging operation using a contactless laser profile measurement. The method and apparatus are particularly useful in controlling center line consolidation of a workpiece during a cogging operation.

Briefly, the method of the present invention measures the real-time length of a workpiece between forging passes. This measurement is necessary for an accurate recording of the center line consolidation areas. This measurement is also necessary because the length can not be derived from theoretical and/or previous data base measurements due to the inhomogeneous quality of the workpiece such as chemical and physical properties. Therefore, elongation after each stroke can not be predicted. This measurement is achieved by a two-dimensional laser scanner, which measures the transverse profile of the workpiece's end when it crosses a measurement plane. The method also includes calculating the current degree of center line consolidation and the bite shift and/or setup point for a next forging pass. The position of the next forging pass is then marked in a process display along with all previous passes of the forging strokes to show the degree of center line consolidation. This is done by a computer program that displays the previous setup points along the workpiece together with the potential position of the next setup point in real time graphics. The program then either suggests to or automatically selects for a forge operator the next setup point, which takes into account all general and special boundary conditions of the forging shop.

Referring to the figures in which like reference numerals indicate like structures throughout, FIG. 1 shows a perspective view of the present forging control system 10 as it is used in conjunction with a workpiece 30 that is being forged between an upper die 32 and a lower die 34 of a forging press. The forging control system 10 as it is configured for use with a forging press may be seen more clearly from the top view in FIG. 2 and having a manipulator gripper 35 and handling chain 36 for supporting and manipulating the workpiece 30

The system 10 of FIG. 1 uses a laser scanning head 14 that is configured in a line scan mode and connected to supporting equipment 15 located within a control room 12. As seen from FIG. 1, the supporting equipment 15 uses a video color display monitor 16, a color image printer 20, a central processing unit 22, and interfacing electronics 24. A workstation 17, which employs a keyboard or other command entry means 28, linked to the supporting equipment 15 is also provided.

A laser scanning head 14, supporting equipment 15, and software for effecting the contactless measurement of a workpiece and consequential computation of its dimension and/or shape are commercially available from FERROTRON Technologies, GmbH, Industrial Measurement Technology, Moers, Germany, a division of Minerals Technologies Inc., as the LACAM (Laser Camera) imaging system, Model E113. Such contactless measuring equipment includes a Laser Line Scanner that uses two main components:

1) A laser distance measuring unit, e.g., a flight of time measurement of a pulsed semiconductor laser, and
2) An optical one-axis beam deflection unit, e.g., a continuously rotating mirror wheel with a rotation angle sensor.

The present inventor with others have described previously in their published International Patent Application WO/01/38900A1, the disclosure of which is incorporated herein by reference, a LACAM laser profile measuring system useful in the non-contact measurement of refractory linings in metallurgical vessels. This technology is based on rapidly scanning the deflection of a pulsed laser beam on a refractory surface to be measured. To carry out the measurement, a three-dimensional grid of measurement values is recorded. The periodic deflection of the laser that is required for this purpose is accomplished in both vertical and horizontal directions by means of a mirror that rotates, respectively, around both the horizontal and vertical axes.

In the paper titled "Laser Measurements on Large Open Die Forging (LACAM-FORGE)," the disclosure of which is incorporated herein by reference, the present inventor with others have also described the use of a LACAM profile measuring system for three-dimensional measuring of the hot workpiece after the forging process and a profile of the workpiece is obtained. The data derived from these measurements are used to determine important geometrical information of the workpiece, i.e. length, width, height, flatness, etc. Additionally, described therein, measurement of a workpiece is performed using a LACAM measuring head like that described in WO/01/38900A1, except that the scanning head is mounted at a fixed position to rotate in at least one of a vertical or horizontal direction, thereby providing a line-scan as produced by the Laser Line Scanner.

Figure 2:
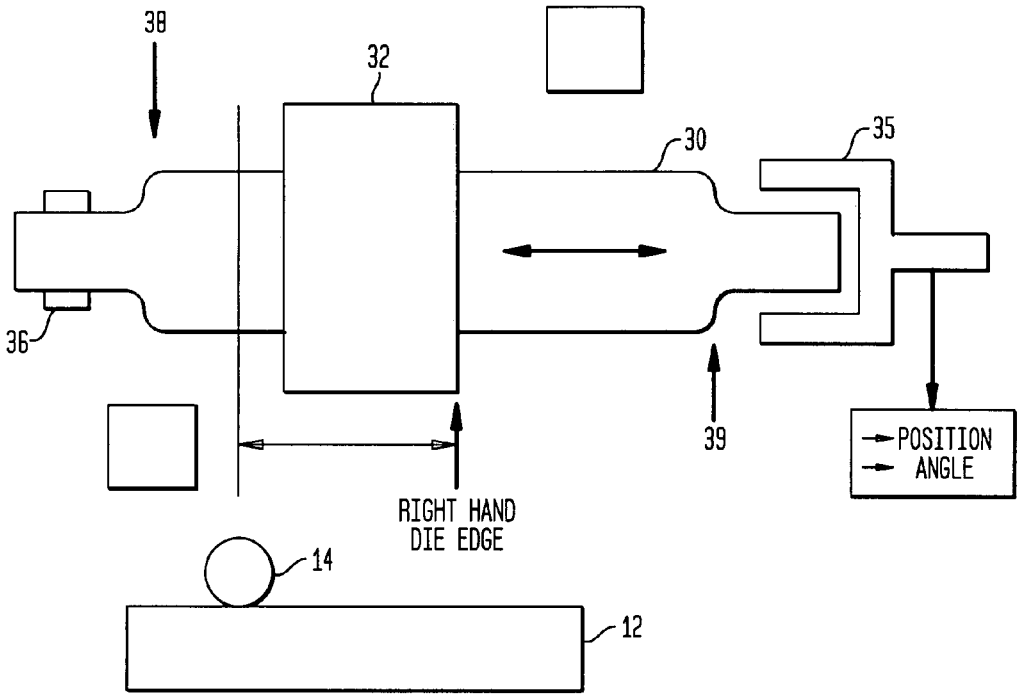
FIG. 2 is a top view of the forging control system used in conjunction with a forging press according to the present invention.

The LACAM scanning head 14 shown in FIG. 1 and FIG. 2, is also operated in a two-dimensional line scan mode to measure a workpiece's profile from the side and detect the workpiece's end whenever it crosses the measurement plane. Using line-scan mode, the deflections of the laser pulses occur in a plane perpendicular to the rotational axis. If an end of the workpiece being forged crosses this measurement plane, the laser pulses of the scanning head hit the workpiece's surface as shown in FIG. 1. If the rotational speed of the mirror in the scanning head is constant and/or unchanging and the laser repetition rate is constant and/or unchanging, the deflection angles of each laser beam have equal angular distance. The distance value of each single laser measurement is recorded simultaneously with the rotation angle of the mirror to provide a coordinate system for the forging press. By combining both values, a two-dimensional Cartesian coordinate map may be obtained for any target-surface which is hit by the laser beam. If these points are plotted on a two-dimensional graph, the measured profile of the workpiece 30 crossing the measurement plane can be displayed.

Figure 3:
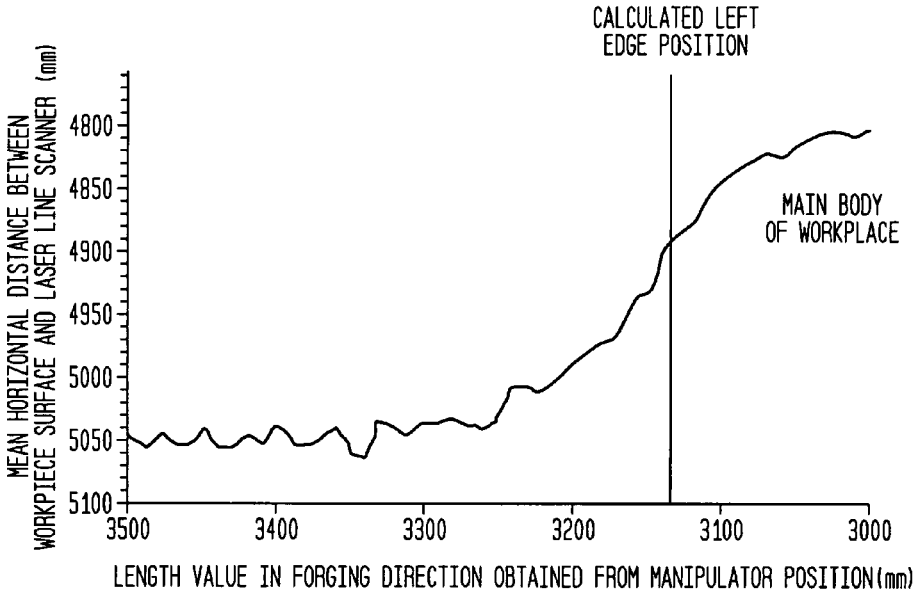
FIG. 3 is a graph of the measured profile of a workpiece generated by mapping the target-surface as it crosses the measurement plane according to the present invention.

By longitudinally moving the end of the workpiece perpendicular to the measurement plane, profiles are obtained and combined to provide a three-dimensional profile as shown in FIG. 3. By analyzing this measured surface, the computer can determine inflection points in the curvature of the workpiece end 38 (FIG. 2). In the case of the workpiece 30 shown in FIG. 1 and FIG. 2, the inflection point of the left workpiece end 38 held by the handling chain 36 is shown calculated from the measurement profile shown in FIG. 3 to determine the position of the left edge 38. The difference between the positions of the reference edge 39 (right hand edge) and the edge for length measurement is then calculated to determine the real-time length of the workpiece after each forging pass. The right edge of the workpiece 30 is measured at the beginning of the process by aligning the right end of the workpiece 30 with the right hand edge of the lower die 34, this being the reference edge 39 shown in FIG. 2. The reference edge usually remains constant and/or unchanged. The process could also be configured so that the reference edge is the left hand edge.

As a result, the current length of workpiece 30, which is increased during each single stroke, can be measured in real time during the forging operation under production conditions. As LACAM measuring systems and their operation for contactless measurement are described in detail in WO/01/38900 A1 and "Laser Measurements on Large Open Die Forging (LACAM-FORGE)," this measurement method will be discussed below with respect to the modifications needed to effect control for center line consolidation in a forging process.

Figure 4:
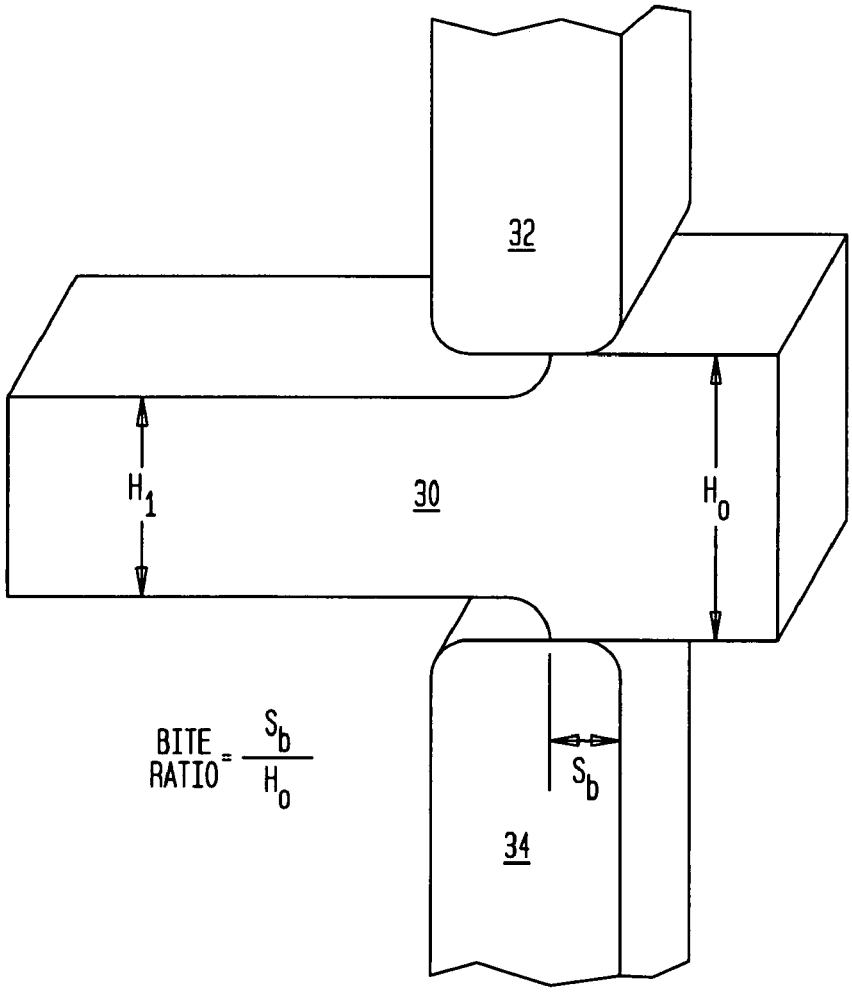
FIG. 4 is a schematic drawing illustrating the bite ratio of a forging process.
Figure 7:
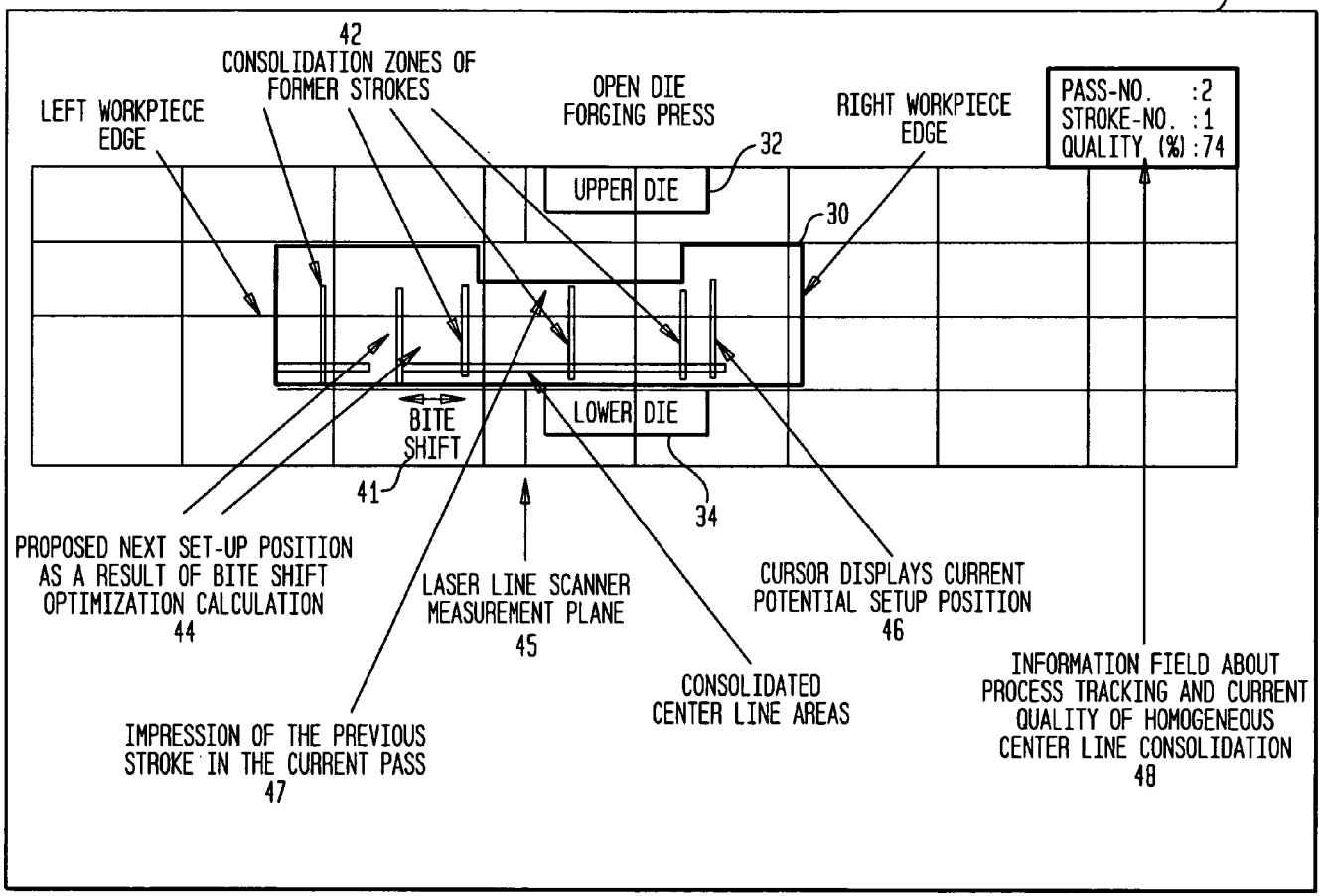
FIG. 7 is a graphical operator display for visually displaying bite tracking and bite shift optimization data according to the present invention.

The method of the present invention also includes calculating the current degree of center line consolidation by controlling the following parameters:

a) Bite Shift which is shown in the visual display in FIG. 7, is the distance 41 between the proposed setup position 44 (i.e., the center position of the contact area between die and workpiece along the workpiece length) and the closest setup position of the previous pass 42. The closest setup positions of the previous passes are influenced by and are repositioned to account for the increase of the workpiece length (elongation) which takes place after each single forging stroke.
b) Bite Ratio ($S_b/H_o$), which is shown illustrated in FIG. 4, is the ratio of width of the contact area between the upper die 32 and lower die 34 and workpiece 30 (effective flat die width, $S_b$) and the workpiece height ($H_o$). A bite ratio of at least 0.5 is required to obtain a suitable consolidation effect.

Figure 5:
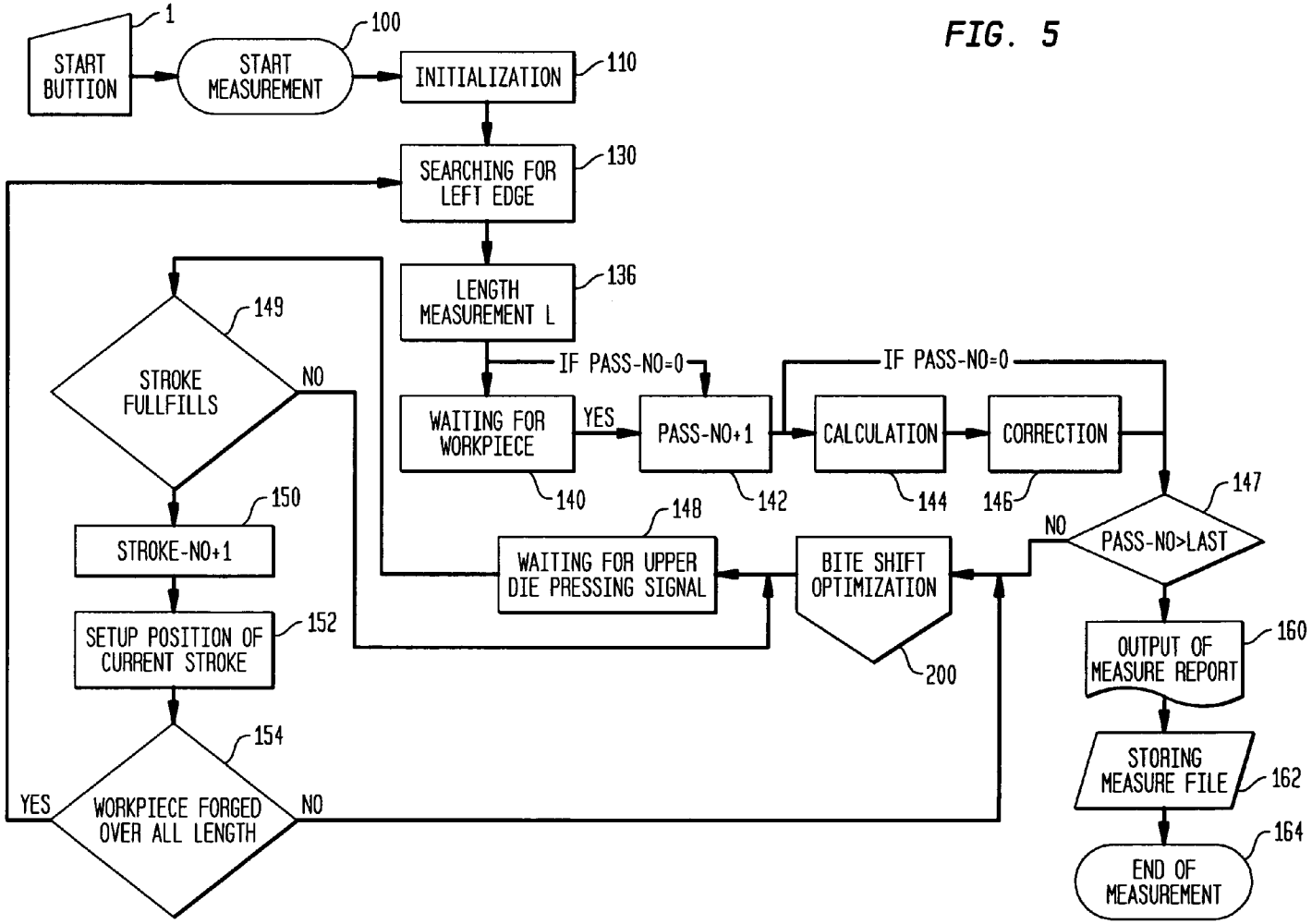
FIG. 5 is a flowchart representing routines used to implement the method according to the present invention.

Additionally, the method and apparatus of the present invention effect centerline consolidation by calculating the bite shift for the next forging stroke according to the flow diagram of the measurement software system as shown in FIG. 5, described in the paragraphs, which follows.

Upon engaging the apparatus by triggering a start button of workstation 17 (1) the right edge 39 (reference edge) of the workpiece 30 is aligned with the right edge of the lower die 34 and/or the upper die 32 and the position is recorded.

The measurement (100) begins now. The system is initialized by resetting the pass number and stroke number to zero (110).

The left edge of the workpiece 30 is passed through the line scanner measurement plane to determine where the inflection point of the left edge 38 of the workpiece 30 is located (130). From these measurements the length of the workpiece is obtained.

If the current pass number is zero the pass number is incremented by one, otherwise the system waits until the workpiece is turned on a longitudinal axis by an angle of 90 degrees (140) and the pass number is incremented by one (142).

After the first pass, elongation of the workpiece is calculated by dividing the current length of the workpiece by the length of previous pass (144). The positions of previous setup points are corrected based on the determined elongation (146) of the workpiece.

Figure 6:
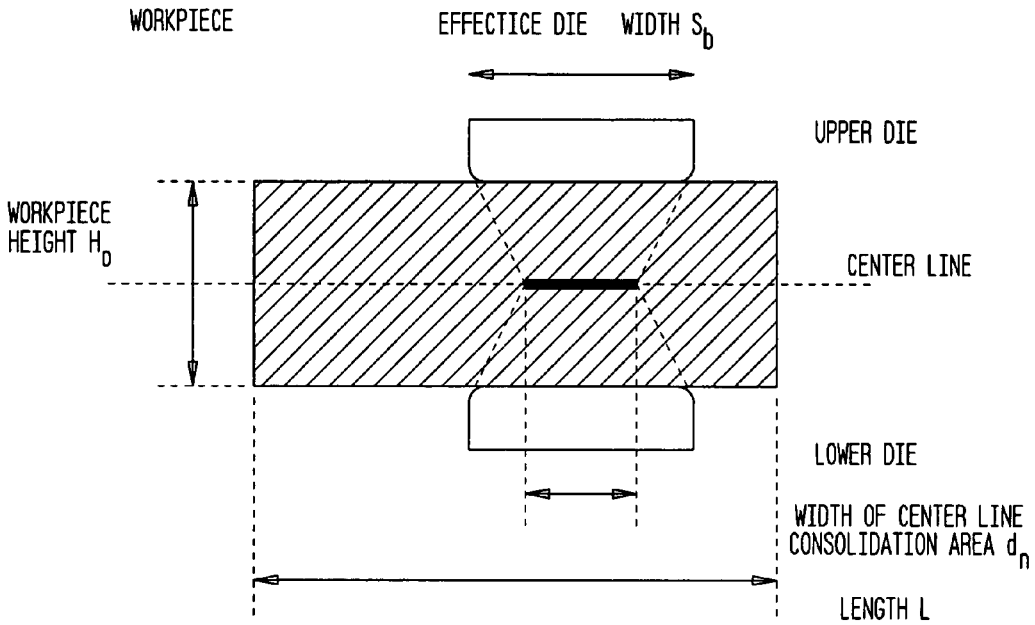
FIG. 6. is a schematic drawing illustrating a model of center line consolidation.
Figure 8:
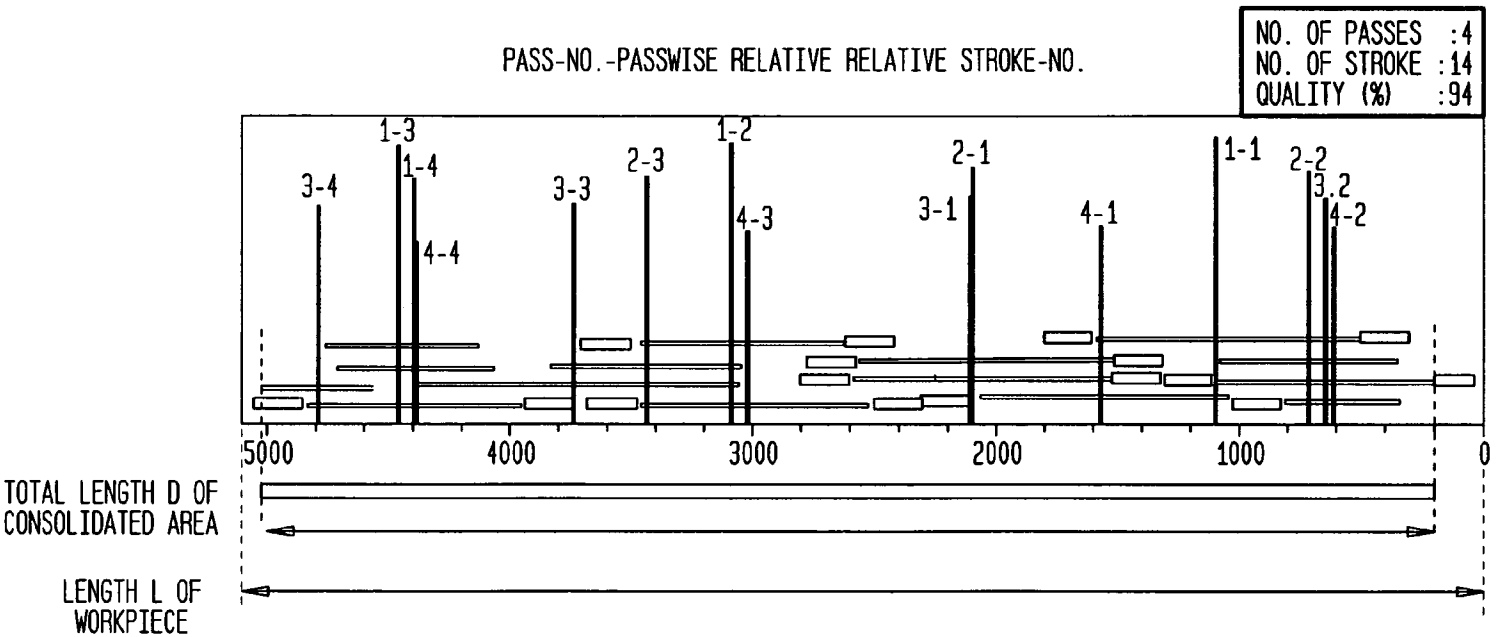
FIG. 8 is a graphical operator interface for visually displaying center line consolidation zone conditions by tracking the setup points of the forging strokes and die width according to the present invention.

The bite shift optimization routine (200) is started resulting in a proposal for the location of the next setup point which is displayed on the operator's monitor 16. The operator decides whether to accept the proposal for the location of the next setup point or to choose a different setup point. Bite optimization is calculated by searching for the best center line consolidation, which can be expressed by the following formulas:

$$d_n = S_b - H_o/F, \text{ where if } (d_n < 0) \text{ then } d_n = 0 \text{ and } F \geqq 2 \quad \text{i)}$$

where $d_n$ is the width of the center line consolidation area of the stroke and "n" is the stroke number, ie. 1, 2, 3 etc. and "F" is an empirical factor with a minimum value of 2. As shown in FIG. 6, the width of the center line consolidation area is dependent upon the effective die width ($S_b$) and the workpiece height ($H_o$) (FIG. 6) which can be obtained from the laser line scanner measurement.

$$D = \text{combined sum of } d_n, \quad \text{ii)}$$

where D is the combined total width of the consolidation areas along the central axis where overlapping areas are not included in the calculation (FIG. 8).

$$Q = 100\% \cdot D/L \quad \text{iii)}$$

where, Q is the percentage quality of center line consolidation and L is the length of the workpiece. If D=L, then consolidation along the entire length of the workpiece has been accomplished (FIG. 8).

The system waits for a signal (148) that the upper die 32 is pressing down on the workpiece 30. After detecting the signal the system checks the bite ratio (149). If the bite ratio is less than 0.5, the system waits for the next signal (148). Otherwise, the stroke number is incremented by one (150).

The position of the manipulator 35 is recorded and compared to the positions of the left edge 38 and right edge 39 of the workpiece 30 in order to determine the setup position of the current stroke (152).

The system now checks whether the whole workpiece has been forged (154). If the workpiece has not been entirely forged, a new bite shift optimization (200) is calculated resulting in a proposal for the next setup point. If the workpiece has been entirely forged in the current pass, the program waits for the left edge 38 of the workpiece 30 to cross the laser line scanner measurement plane (130) and the length of the workpiece is determined.

After the last pass is forged the tracking and bite shift optimization routine is terminated (164). A report is generated showing the distribution of the setup points and quality of the center line consolidation (160).

A measurement file is stored (162) in a central processing unit 22 and the stored process data can be used for off-line visualization.

FIG. 6 illustrates how the width of the center line consolidation area can be calculated.

Shown in FIG. 7 is a tracking and bite shift optimization recording 40 that assists a forge operator in visualizing the process in which bite tracking and bite shift 41 are shown for both consolidation zones of previous strokes 42 and a proposed setup point position (i.e., proposed forging location) for a next forging stroke 44. An impression 47 of the previous stroke in the current pass and the real time position of the workpiece 30 are shown with respect to the upper die 32, the lower die 34, and the laser line scanner measurement plane 45. A cursor 46 is also shown which displays a current potential setup position that may be selected by the forge operator. An information field 48 is shown that displays the calculated quality index of the center line consolidation for the setup position of the cursor 46 location. The previous and proposed setup point positions and the cursor are distinguishable by at least one of color, shape, and/or other indicia.

Shown in FIG. 8 is an additional operator display that tracks the center line consolidation zone conditions by tracking the setup points (shown as vertical lines) of the strokes and widths of the consolidation areas (shown as horizontal lines) and labeled according to the pass and stroke numbers of the forging blow as shown. The orientation angles of the workpiece for each forging stroke are graphically represented by color-coding the lines.

The method and apparatus according to the present teachings assists the operator to make decisions for the setup point positions, because real time information about the current center line consolidation is provided in which all former setup points are displayed on a computer screen. The position of the next potential setup point is displayed and the quality factor for this setup point is calculated. The method provides a proposal for the optimal setup point, which is calculated using general and customer-specific rules and boundary conditions. The current teachings include a real time visualization of the process and the possibility to store the process data for off-line visualization which can be used for further analysis, e.g., to evaluate the work of the operators and so to improve the process.

Although described above as having the capability for interactive control by a human operator, the process may also be set to be fully automated such that upon an operator giving a start signal, the software runs automatically up to a defined number of passes and a measurement report is automatically generated.

While embodiments and applications of this invention have been shown and described, it will be apparent to those skilled in the art that many more modifications are possible without departing from the inventive concepts herein described. For example, although described above with respect to use LACAM measuring apparatus, it is envisioned that the optimized forging method according to the present invention may be performed using other electro-optical methods and apparatus such as a CCD-camera with image processing; a simple light sensor in case of small workpieces having a simple cut end; and/or by using laser scanner directly onto the workpieces end in the elongation direction. It is understood, therefore, that the invention is capable of modification and therefore is not to be limited to the precise details set forth. Rather, various modifications may be made in the details within the scope and range of equivalents of the claims without departing from the metes and bounds of the invention.

What is claimed is:

1. A method of forging of a workpiece that is moved along a longitudinal axis of a forging press and having first and second ends transverse thereto, comprising:

detecting the relative positions of the first and second ends of the workpiece along the longitudinal axis by detecting the presence of each of the first and second ends as each of the first and second ends crosses a measuring plane transverse to the longitudinal axis, calculating a length of the workpiece between the first and second ends, determining the intial height ($H_o$) of the workpiece transverse to the longitudinal axis, and calculating a bite ratio ($S_b/H_o$) for a prospective forging location on the workpiece, wherein $S_b$ is an effective flat die width of the forging press, and determining if the bite ratio is greater than 0.5.

2. The method according to claim 1, wherein detecting the relative positions of the first end and second end is performed using a laser scanning apparatus.

3. The method according to claim 1, wherein if the calculated bite ratio is greater than 0.5, identifying the prospective forging location as a proposed forging location.

4. The method according to claim 3, wherein after a forging blow is performed by the forging press:

the relative positions of the first and second ends of the workpiece along the longitudinal axis is detected and calculating a length of the workpiece therebetween; and iteratively moving the workpiece along the longitudinal axis to a new proposed forging location and determining if the bite ratio is greater than 0.5.

5. The method according to claim 4, further comprising calculating center line consolidation for the proposed forging location prior to performing the forging blow.

6. The method according to claim 5, wherein the center line consolidation is calculated by the equation:

$$d_n=S_b-H_o/F, \text{ where if } (d_n<0) \text{ then } d_n=0 \text{ and } F\geqq 2$$

where:

$d_n$ is the width of the center line consolidation area of the stroke and n is the stroke number $S_b$ is the effective flat die width $H_o$ is the workpiece height and F is an empirical factor with a minimum value of 2.

7. The method according to claim 6, wherein the centerline consolidation is calculated by the equation:

$$D=\text{combined sum of } d_n$$

where:

D is the combined total width of the consolidation areas along the central axis where overlapping areas are not included in the calculation.

8. The method according to claim 7, wherein the center line consolidation is calculated by the equation:

$$Q=100\%\cdot D/L$$

where:

Q is the percentage quality of center line consolidation and

L is the length of the workpiece.

9. The method according to claim 7, wherein the center line consolidation is output graphically.

10. The method according to claim 3, wherein after a forging blow is performed at a location the locations of the forging blows are output graphically.

11. The method according to claim 3, wherein the prospective forging location is automatically selected as the actual forging location.

12. The method according to claim 1, wherein if the calculated bite ratio is less than or equal to 0.5 the step of iteratively moving the workpiece along the longitudinal axis to a new proposed forging location until the calculated bite ratio is greater than 0.5 and identifying the prospective forging location as a proposed forging location.

13. The method according to claim 12, wherein after a forging blow is performed by the forging press:

detecting the relative positions of the first and second ends of the workpiece along the longitudinal axis and calculating a length of the workpiece therebetween; and iteratively moving the workpiece along the longitudinal axis to a new proposed forging location and determining if the bite ratio is greater than 0.5.

14. The method according to claim 13, further comprising calculating a center line consolidation for the proposed forging location prior to performing the forging blow.

15. A system for the forging of a workpiece that is moved along a longitudinal axis of a forging press and having first and second ends transverse thereto according to the method of claim 1, comprising:

a means for detecting the relative positions of the first and second ends of the workpiece along the longitudinal axis by detecting the presence of each of the first and second ends as each of the first and second ends crosses a measuring plane transverse to the longitudinal axis, a means for calculating a length of the workpiece between the first and second ends, a means for determining the intial height ($H_o$) of the workpiece transverse to the longitudinal axis, and a means for calculating a bite ratio ($S_b/H_o$) for a prospective forging location on the workpiece, wherein $S_b$ is an effective flat die width of the forging press, and a means for determining if the bite ratio is greater than 0.5.

16. The system according to claim 15, wherein the means for detecting the relative positions of the first end and second end is a laser scanning apparatus.

* * * * *